United States Patent [19]

Curley et al.

[11] Patent Number: 4,973,038

[45] Date of Patent: Nov. 27, 1990

[54] SIGNATURE HANDLING APPARATUS

[75] Inventors: Richard D. Curley, Dayton, Ohio; Edward L. Kempisty, Rouses Point, N.Y.

[73] Assignee: AM International Incorporated, Chicago, Ill.

[21] Appl. No.: 403,586

[22] Filed: Sep. 6, 1989

[51] Int. Cl.[5] ..... B64H 1/02

[52] U.S. Cl. ..... 271/146; 271/150; 271/161; 271/221

[58] Field of Search ..... 271/149, 150, 151, 31.1, 271/129, 146, 161, 221

[56] References Cited

U.S. PATENT DOCUMENTS

| | | | |
|---|---|---|---|
| 3,674,258 | 7/1972 | Maier, Jr. et al. . | |
| 3,881,718 | 5/1975 | Fernandez-Rana | 271/150 X |
| 3,945,633 | 3/1976 | Knopp . | |
| 4,177,982 | 12/1979 | Bewersdorf et al. . | |
| 4,180,255 | 12/1979 | Himmel . | |
| 4,183,517 | 1/1980 | Hageman | 271/150 |
| 4,436,297 | 3/1984 | Chandhoke . | |
| 4,531,343 | 7/1985 | Wood | 271/151 X |
| 4,588,180 | 5/1986 | Ballestrazzi | 271/31.1 X |
| 4,747,592 | 5/1988 | Pessina | 271/31.1 X |

*Primary Examiner*—Richard A. Schacher
*Attorney, Agent, or Firm*—Tarolli, Sundheim & Covell

[57] ABSTRACT

A signature supply apparatus moves signatures in an on-edge orientation to a signature feed apparatus which feeds the signatures one at a time. The signature supply apparatus includes a generally horizontal main section which supports a large number of signatures in an on-edge orientation with major side surfaces of the signatures upright. A hopper section is disposed at a higher level than the main section and supports on-edge signatures with the major side surfaces of the signatures upright and with a forwardmost signature positioned to be engaged by the signature feed apparatus. An inclined ramp section extends forwardly and upwardly from the main section to the hopper section. The ramp section supports the signatures on-edge in a thick shingled stream with major side surfaces of the signatures inclined forwardly and upwardly. The main, ramp and hopper sections of the improved signature supply apparatus support a continuous stream of on-edge signatures. A deflector assembly may be mounted on the main section of the signature supply apparatus to bow the signatures forwardly and separate major side surfaces of the signatures.

17 Claims, 6 Drawing Sheets

SIGNATURE HANDLING APPARATUS

BACKGROUND OF THE INVENTION

The present invention relates to a new and improved signature handling apparatus having a signature supply assembly which supplies signatures in an on-edge orientation to a signature feed assembly which feeds the signatures one at a time.

A signature feed assembly is commonly used to feed signatures one at a time from a hopper onto a conveyor. One known signature feed assembly for feeding signatures one at a time onto a conveyor is disclosed in U.S. Pat. No. 4,180,255, issued Dec. 25, 1979 and entitled "Wiper System Inserter". Known signature supply assemblies have previously been used to supply signatures to a hopper in a signature feed assembly. Known signature supply assemblies or hopper loaders, are disclosed in U.S. Pat. No. 3,674,258 issued July 4, 1972 and entitled "Method and Apparatus for Feeding Stacked Sheet Material" and in U.S. Pat. No. 3,945,633, issued Mar. 23, 1976 and entitled "Hopper Loader". The signature supply assemblies disclosed in the aforementioned U.S. Pat. Nos. 3,674,258 and 3,945,633 supply signatures to a hopper with major sides of the signatures in a generally horizontal orientation.

Known signature supply assemblies for supplying signatures in an on-edge orientation are disclosed in U.S. Pat. Nos. 4,177,982 issued Dec. 11, 1979 and entitled "Sheet Feeders" and U.S. Pat. No. 4,436,297, issued Mar. 13, 1984 and entitled "Horizontal Bindery Loader Adaptor for Feeding Signatures into a Vertical Pocket". The signature supply assemblies disclosed in these patents supply signatures in an on-edge orientation from which the signatures are fed one at a time by a signature feed assembly. The construction and mode of operation of these known on-edge signature supply assemblies is relatively complicated. The complicated nature of the construction and mode of operation of known on-edge signature supply assemblies increases the probability of a jam or other malfunction during operation of the signature supply assemblies. Of course, the more complicated the construction of the signature supply assembly, the greater will be the cost.

BRIEF SUMMARY OF THE INVENTION

An improved signature supply assembly conducts signatures in an on-edge orientation to a known signature feed assembly which feeds the signatures one at a time. The signature supply assembly has a relatively long main section and supports a substantial number of signatures in an on-edge orientation with major side surfaces of the signatures upright. A hopper section is disposed at a higher level than the main section to support signatures on edge with major side surfaces of the signatures upright. A signature which is to be engaged next by the signature feed assembly is disposed at the forward end of the hopper section. An inclined ramp section extends forwardly and upwardly from the main section to the hopper section to support on-edge signatures with major side surfaces of the signatures inclined forwardly and upwardly.

The main, ramp and hopper sections of the signature supply assembly support a continuous stream of on-edge signatures. A drive assembly presses the major side surfaces of the signatures on the main and ramp sections against each other to transmit force between the signatures urging the signatures forwardly and upwardly toward the hopper section.

The signatures may tend to adhere to each other causing a misfeed by the signature feed assembly. To prevent this from occurring, a deflector assembly may be provided to bow the signatures. The deflector assembly bows the signatures to facilitate subsequent feeding of the signatures one at a time from the end of the stream of signatures. The deflector assembly includes rollers which engage opposite sides of the stream of signatures and which rotate in only one direction during back and forth movement of the rollers along the stream of signatures.

BRIEF DESCRIPTION OF THE DRAWINGS

The foregoing and other objects and features of the present invention will become more apparent upon a consideration of the following description taken in connection with the accompanying drawings, wherein.

DESCRIPTION OF ONE SPECIFIC PREFERRED EMBODIMENT EMBODIMENT OF THE INVENTION

General Description

Figure 1:
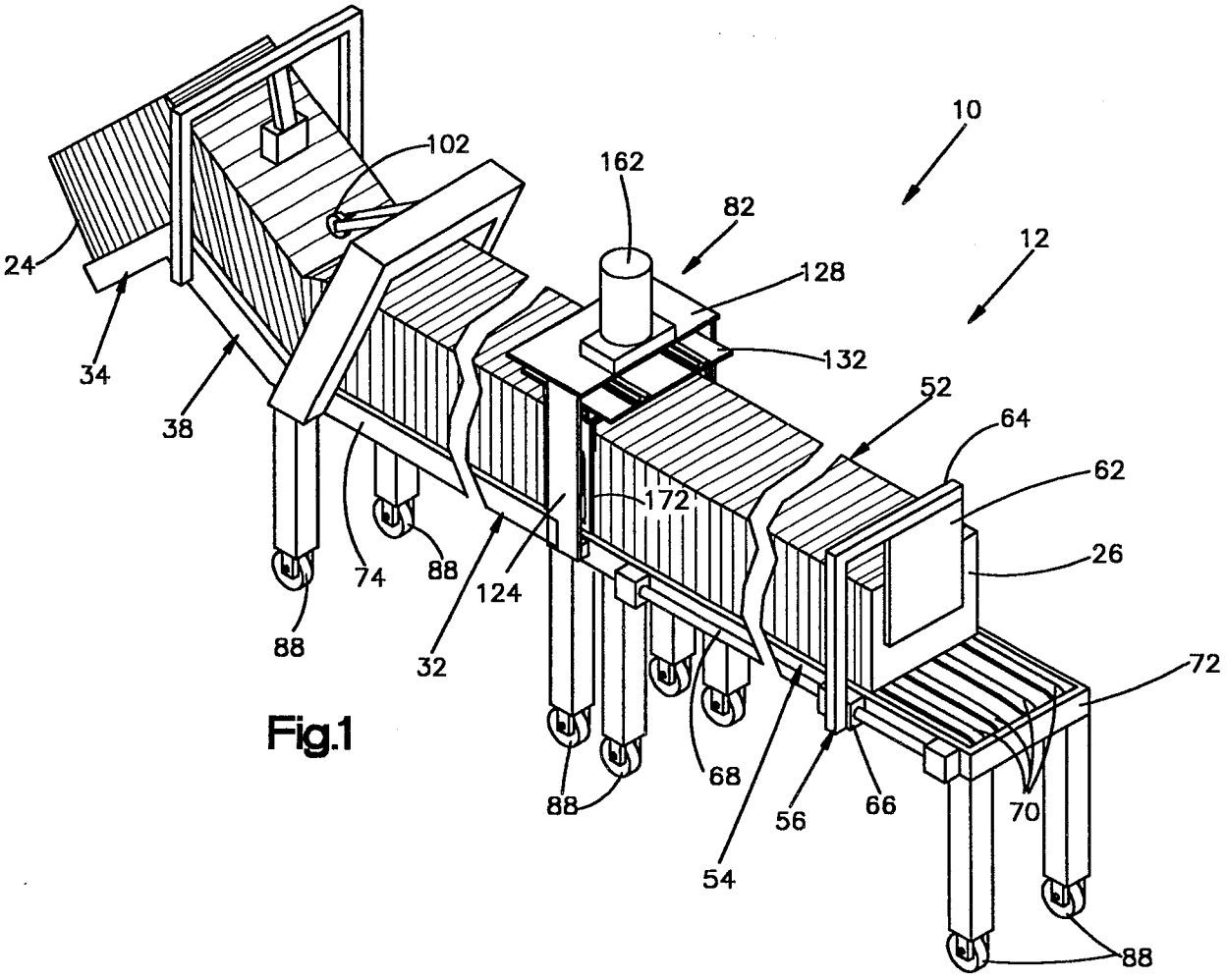
FIG. 1 is a schematicized pictorial illustration of a signature supply assembly constructed in accordance with the present invention.

A sheet material handling apparatus 10 (FIGS. 1 and 2) receives printed signatures and sequentially deposits them on a conveyor assembly. The sheet material handling apparatus 10 includes an improved signature supply assembly 12 (FIG. 1) which supplies signatures in an on-edge orientation to a known signature feed assembly 14 (FIG. 2). The signature feed assembly 14 feeds the signatures one at a time from the signature supply assembly 12 onto a saddle-type conveyor 15 (FIG. 2).

The signature feed assembly 14 is of a known construction and includes a hopper rotor drum 16 (FIG. 2), a transfer drum 18 and an opener drum 20. Vacuum is applied by suckers (not shown) to a leading or forwardmost signature 24 on the signature supply assembly 12. The suckers move the forwardmost signature 24 into a position in which it can be gripped by a gripper on the hopper rotor drum 16. Rotation of the hopper rotor drum 16 pulls the on-edge signature 24 from the signature supply assembly 12. A transfer drum 18 removes the signature from the rotor drum 16. The transfer drum 18 and opener drum 20 then open the signature and drop the signature onto the saddle conveyor 15. As the saddle conveyor 15 passes under a plurality of signature feed assemblies 14, signatures 26 are gathered to form a collated group of signatures.

The plurality of signature feed assemblies are disposed in a linear array and have the same construction as the signature feed assembly 14. Although it is preferred to use the signature supply assembly 12 to supply signatures to each of the signature feed assemblies 14, different sources of on-edge signatures could be used for some of the signature feed assemblies if desired. The hopper rotor drum 16, transfer drum 18 and opener drum 20 have the same construction as in the Harris SP 950 Saddle Stitch System which has a P-18 hopper sold by Harris Graphics Corporation, Bindery Systems Division having a place of business at 4900 Webster Street, Dayton, Ohio U.S.A.

Although the signature supply assembly 12 has been illustrated in FIG. 2 in association with a known signature feed assembly 14 which feeds signatures one at a time to a saddle-type conveyor 15, it is contemplated that the signature supply assembly 12 could be used with different types of signature feed assemblies. For example, the signature supply assembly 12 could be used with a signature feed assembly which feeds signatures to a conveyor which moves the signatures with the major side surfaces of the signatures flat in generally horizontal planes. In fact, it is contemplated that the signature supply assembly 12 could be used with a signature feed assembly which feeds signatures to devices other than collating conveyors.

Figure 2:
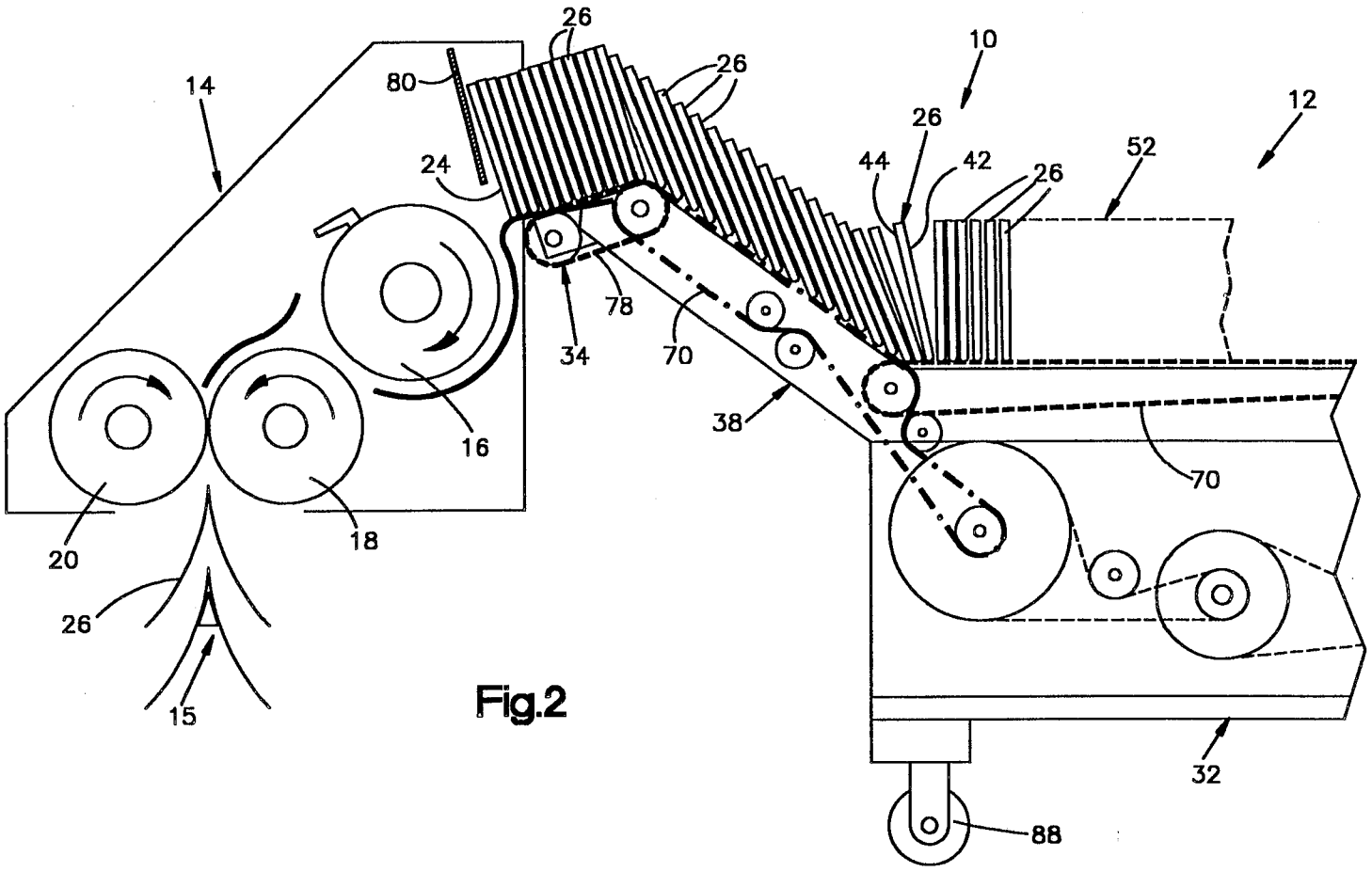
FIG. 2 is a schematic illustration depicting the relationship between the signature supply assembly of FIG. 1 and a signature feed assembly.
Figure 3:
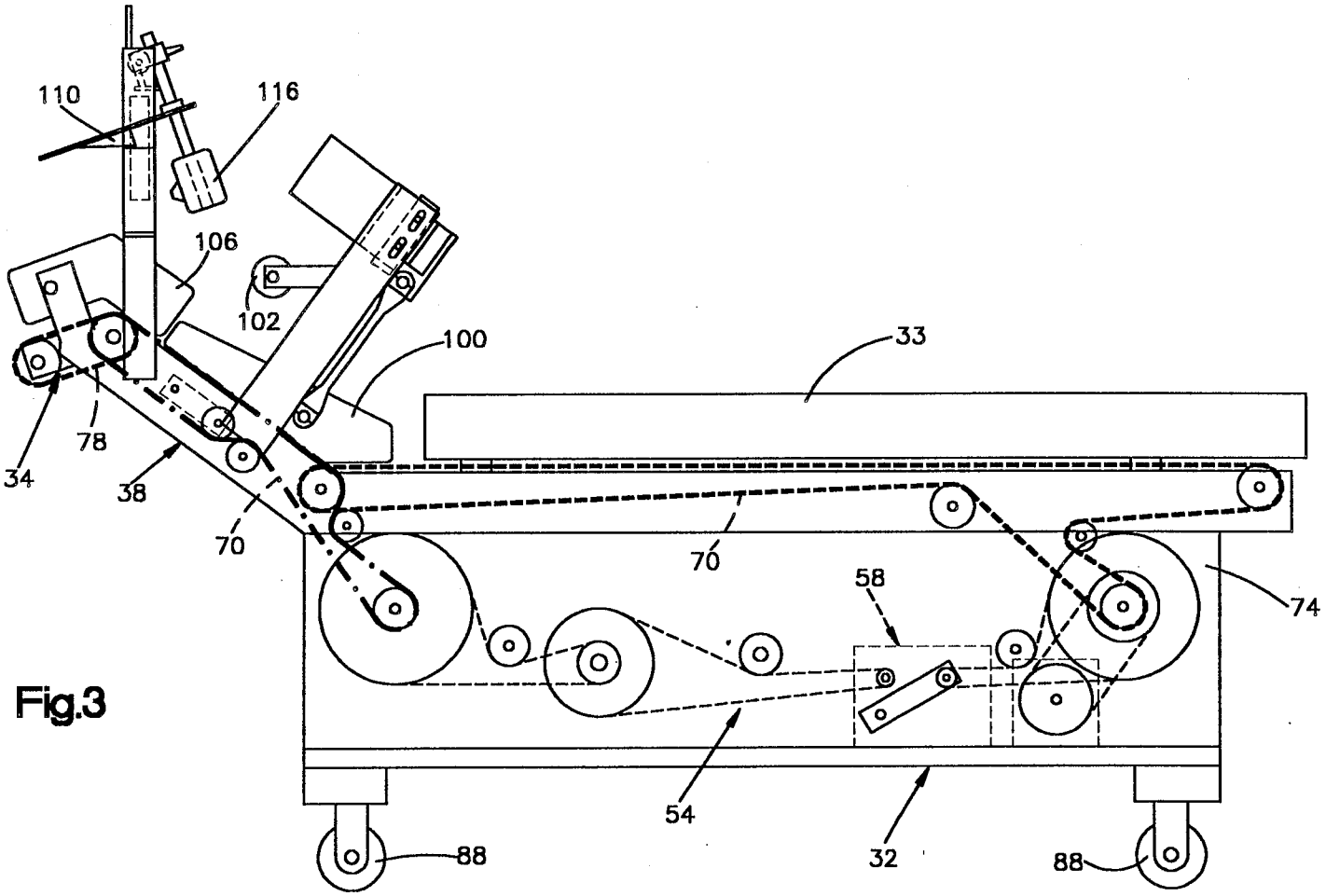
FIG. 3 is a side elevational view of a portion of the signature supply assembly of FIG. 1.

The signature supply assembly 12 includes a relatively long main section 32 which holds a large number of on-edge signatures and feeds them along a horizontal path (FIGS. 1 and 3). Suitable side guides 33 (FIG. 3) extend along the main section 32 to guide movement of the signatures 26. A hopper section 34 (FIGS. 1–4) is disposed at a higher level than the main section 32 and holds the signatures 26 in an on-edge orientation (FIG. 2) for engagement by the signature feed assembly 14. The signature feed assembly 14 sequentially engages the forwardmost signature 24 in the hopper section 34 and feeds that signature to the conveyor 15 (FIG. 2).

A ramp section 38 extends between the leading end of the horizontal main section 32 and the trailing end of the hopper section 34 (FIGS. 2 and 3). The ramp section 38 moves on-edge signatures 26 (FIG. 4) forwardly and upwardly from the main section 32 to the hopper section 34 in a thick shingled stream. Leading and trailing major side surfaces 42 and 44 on each of the on-edge signatures 26 in the thick shingled stream on the ramp section 38 have leading and trailing major side surfaces 42 and 44 which are upright and inclined forwardly and upwardly relative to a longitudinal central axis 48 (FIG. 4) of the ramp section 34.

The main, ramp and hopper sections 32, 34, and 38 of the signature supply apparatus 12 support a continuous stream 52 (FIG. 1) of on-edge signatures. The continuous stream 52 of on-edge signatures extends from the main section 32, up the ramp section 38 and through the hopper section 34 of the signature supply assembly 12. The signatures 26 in the continuous stream 52 have upright major side surfaces disposed in abutting engagement with each other throughout the length of the continuous stream.

The signatures 26 in the continuous stream may be formed from one or more sheets of material. When the signatures 26 are to be fed to a saddle conveyor, the signatures have a folded lower edge portion. Of course, when the signatures are to be fed to a flat-type conveyor, rather than a saddle-type conveyor, the signatures 26 would not necessarily have a folded lower edge portion.

A drive assembly 54 (FIGS. 1 and 3) presses the major side surfaces 42 and 44 of the signatures 26 against each other on the main and ramp sections 32 and 38 of the signature supply apparatus 12. The force transmitted between the major side surfaces of the signatures 26 moves the on-edge signatures forwardly and upwardly along the ramp section 38 toward the hopper section 34. The major side surfaces of the signatures 26 in the hopper section 34 press against each other to move the on-edge signatures forwardly and downwardly toward the signature feed assembly 14 during operation of the signature feed assembly.

By having the continuous stream 52 of on-edge signatures 26 move along the signature supply assembly 12 under the influence of forces applied against the major side surfaces 42 and 44 of the signatures, a relatively simple drive assembly 54 can be used to move the signatures. Due to the relatively simple construction of the drive assembly 54, jams and/or misfeeds of signatures are avoided. If, for some unforeseen reason, a jam should occur, the simple construction of the drive assembly 54 enables the jam to be quickly and easily cleared.

The drive assembly 54 includes a pusher assembly 56 (FIG. 1) on the main section 32 of the signature supply assembly 12 and a belt drive assembly 58 (FIG. 3). The pusher drive assembly 56 includes a pusher plate 62 (FIG. 1) which presses against a trailing or rearwardmost signature 26 in the continuous stream 52 of signatures. The pusher plate 62 is pressed against the signatures 26 by a drive arm 64 which is connected to a drive nut 66. The drive nut 66 is moved toward the left (as viewed in FIG. 1) by a drive screw 68. During operation of the signature supply apparatus 12, the drive screw 68 rotates to move the nut and drive arm 64 to press the pusher plate 62 against the trailing end of the continuous stream 52 of signatures.

The belt drive assembly 58 (FIG. 3) intermittently drives conveyor belts 70 (FIG. 1) in the main section 32 of the signature supply apparatus 12. The main section 32 of the signature supply apparatus 12 includes a rearward or extension section 72 (FIG. 1) and a forward section 74. The belt drive assembly 58 is disposed in the forward section 74 (FIG. 3) and drives conveyor belts 70 in both the extension and forward sections 72 and 74. Conveyor belts in the extension section 72 may be driven by a separate source of power located in the extension section if desired. In addition, the drive for the pusher screw 68 may be provided by the belt drive assembly 58 or by a separate source of power in the extension section 72.

The extension section 72 has a length of approximately 92 inches, while the forward section 74 has a length of approximatey 70 inches. Although the extension section 72 is used in association with the forward section 74 to provide more than 13 feet of length for holding on-edge signatures, the forward section 74 has a length which is more than is required to accept a four foot log or stack of signatures received from a printing press. Thus, the forward section 74 can be used either with the extension section 72 for extra capacity or without the extension section. It should be understood that the foregoing dimensions of the extension and forward sections 72 and 74 have been set forth for purposes of clarity of illustration and not for purposes of limiting the invention.

As the on-edge signatures 26 move up the ramp section 38 (FIG. 4), the lower edge portions of the signatures engage conveyor belts 70. The upright signatures 26 are pushed up the ramp section 38 by forces transmitted between the major side surfaces of the signatures. At the same time, the conveyor belts 70 move the lower edge portions of the on-edge signatures 26 up the ramp section.

On the ramp section 38, the on-edge signatures 26 lean forwardly and form a thick shingled stream which extends from the main section 32 to the hopper section 34. Although the upright signatures 26 lean forwardly on the ramp section 38, the signatures maintain their on-edge orientation so that the major side surfaces 42 and 44 of the signatures extend upwardly away from the conveyor belts 70. This enables the signatures 26 to be pushed up the ramp section 38 under the influence of forces transmitted between the major side surfaces of the signatures.

Once the signatures 26 in the continuous stream 52 of on-edge signatures have moved to the hopper section 34, they are advanced by feed chains 78. The feed chains 78 engage the lower edge portions of the upright signatures and sequentially move the signatures forwardly in timed relationship with the operation of the signature feed assembly 14. In order to coordinate the feeding of on-edge signatures 26 from the hopper section 34 with the operation of the signature feed assembly 14, the feed chains 78 in the hopper section 34 are driven by the signature feed assembly 14. The signature feed assembly 14 includes a cam driven pusher bar (not shown) which actuates a ratchet to index the feed chains 78 in the hopper section 34 in timed relationship with rotation of the hopper rotor drum 16 (FIG. 2). Since the construction of the drive for the feed chain 78 is well known, it will not be described further herein.

During operation of the signature feed assembly 14, the feed chains 78 are intermittently driven to move a next succeeding on-edge signature 26 into engagement with a positioning or stop plate 80 (FIG. 2) each time a signature is removed from the hopper section 34 by the hopper rotor drum 16. As the upright signatures 26 are removed from the hopper section 34, the drive assembly 54 is intermittently operated to move on-edge signatures into the hopper section. Therefore, a continuous supply of on-edge signatures is maintained in the hopper section 34.

Figure 5:
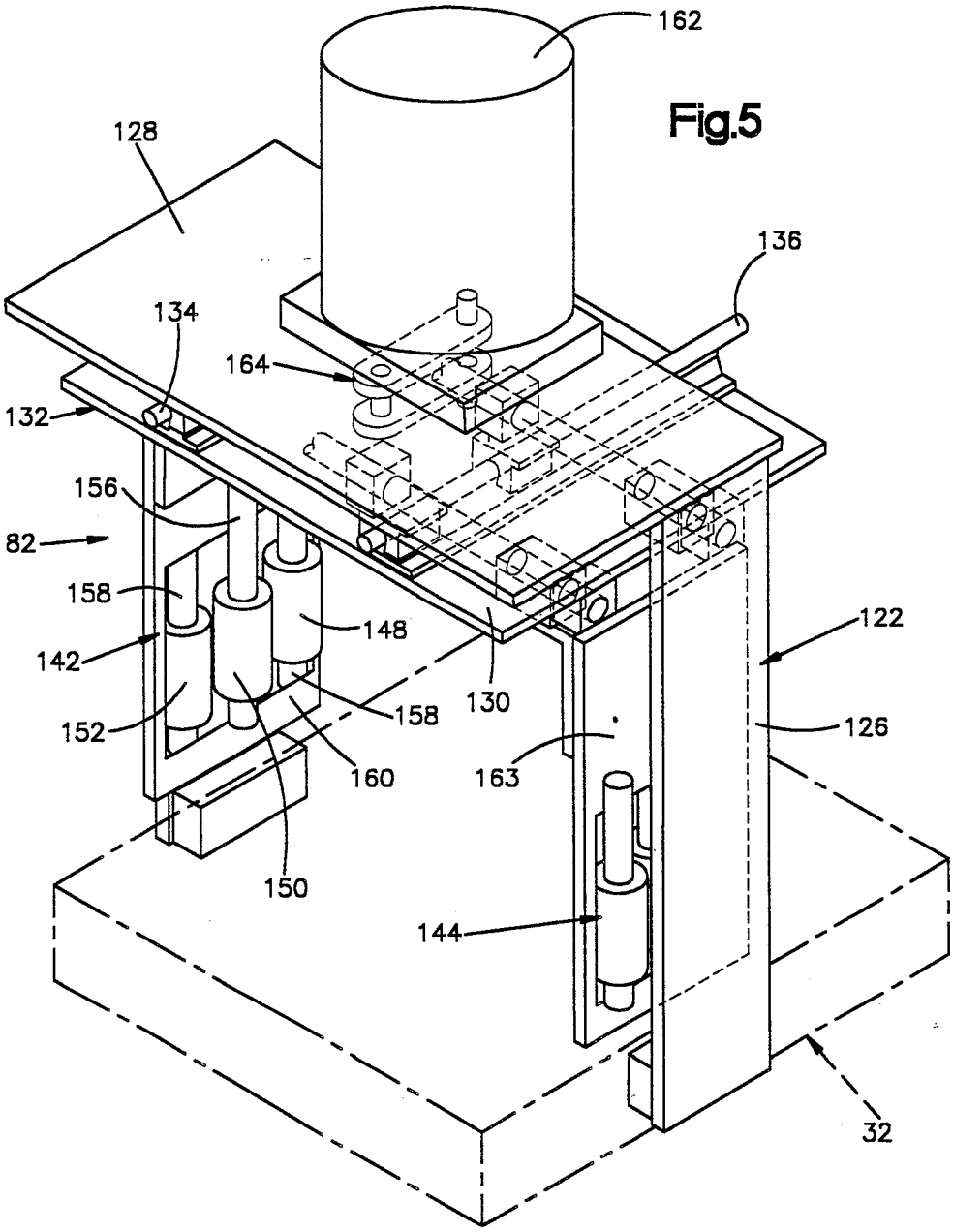
FIG. 5 is a pictorial illustration of a deflector assembly which may be used with the main section of the signature supply assembly of FIG. 1.

A deflector assembly 82 (FIGS. 1 and 5) may be provided on the forward section 74 of the signature supply assembly 12. It is contemplated that, for certain signatures, the deflector assembly 82 will not be required. However, for signatures which have a particularly strong tendency to stick together or adhere to each other, the provision of the deflector assembly 82 may be desired in order to facilitate separating the signatures for feeding one at a time from the hopper section 34.

The deflector assembly 82 extends across the continuous stream 52 of signatures 26 (FIG. 1) and engages opposite sides of the stream of signatures to bow the signatures forwardly in a direction parallel to the longitudinal axis of the stream of signatures. Although it may be preferred to use the deflector assembly 82 with certain types of signatures, it is contemplated that the deflector assembly may be omitted when other types of signatures are being fed. In addition, it is contemplated that the deflector assembly 82 may be used with a signature supply assembly having a construction which is different than the construction of the signature supply assembly 12.

The signature supply assembly 12 is movable relative to the signature feed assembly 14 (FIG. 2). To accommodate movement of the signature supply assembly 12, a plurality of wheels 88 (FIG. 3) are provided on the main section 32. The wheels 88 enable the signature supply assembly 12 to be moved away from the signature feed assembly 14. Known hopper feed chains can be mounted in association with the signature feed assembly to feed signatures when the signature supply assembly 12 is moved away from the signature feed assembly 14. In addition, the signature supply assembly 12 can be moved to a location remote from one signature feed assembly 14 for use in association with a second signature feed assembly. Of course, the ability to move the signature supply assembly 12 relative to the signature feed assembly 14 facilitates the clearing of any jams which may occur in the signature feed assembly 14 or the signature supply assembly 12. In addition, maintenance of both the signature feed assembly 14 and the signature supply assembly 12 is facilitated.

Ramp Section

Figure 4:
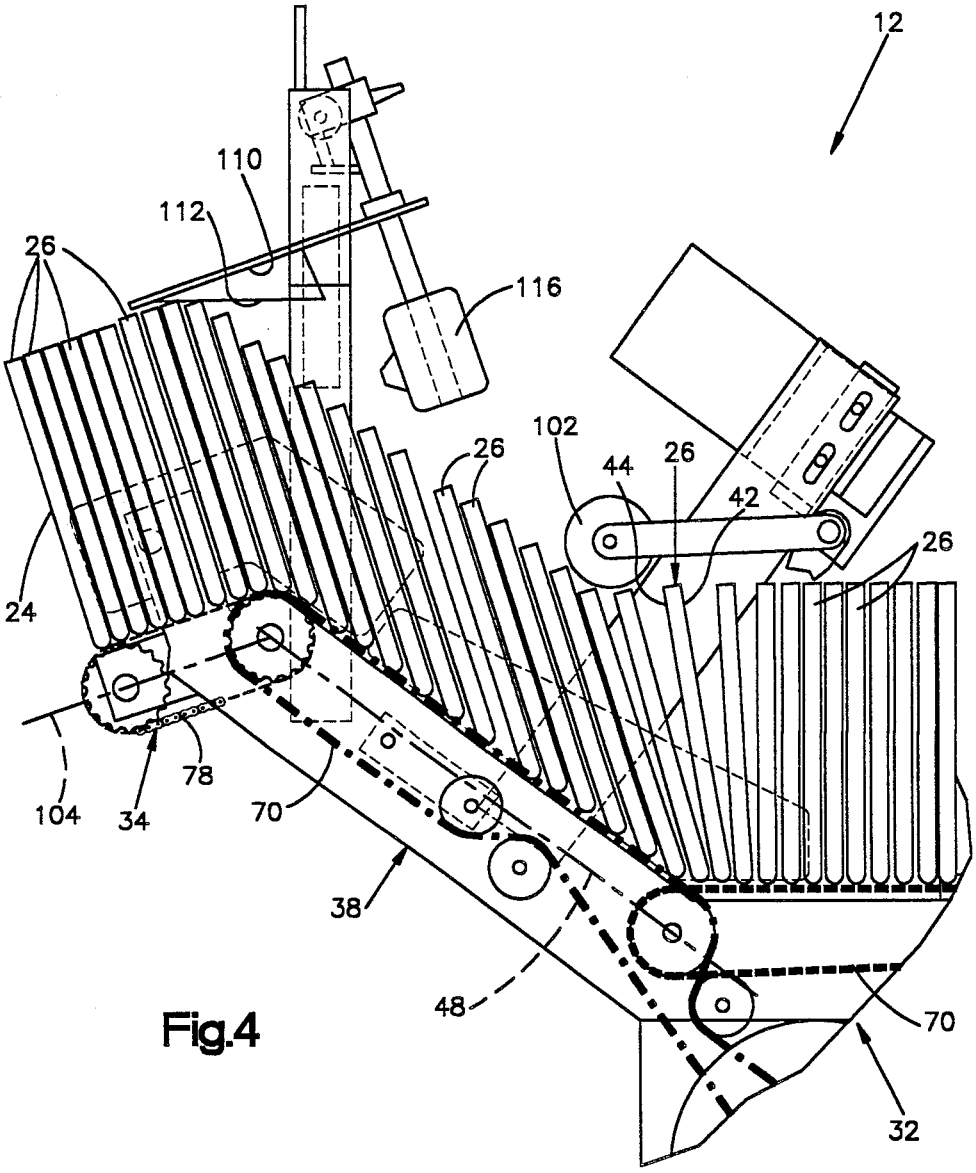
FIG. 4 is an enlarged side elevational view of a ramp section of the signature supply assembly of FIG. 1 and illustrating the manner in which on-edge signatures move from a main section, up a ramp section to a hopper section of the signature supply assembly.

The ramp section 38 supports the on-edge signatures 26 in a thick shingled stream with the major side surfaces 42 and 44 of the signatures upright (FIG. 4). The major side surfaces 42 and 44 of the signatures on the ramp section 38 are inclined forwardly and upwardly relative to the longitudinal central axis 48 of the ramp section 38. Since the major side surfaces 42 and 44 of the upright on-edge signatures 26 are in abutting engagement as the signatures move along the ramp section 38, the forces for moving the signatures up the ramp section can be transmitted between the major side surfaces of the signatures. In addition, the belts 70 engage the folded lower edge portion of the signatures and move the lower edge portions of the signatures up the ramp section 38.

At the junction between the horizontal main section 32 and upwardly extending ramp section 38, the on-edge signatures are tipped or pivoted forwardly about their folded lower edges to move the major side surfaces 42 and 44 of the signatures from a generally vertical orientation to a forwardly and upwardly inclined orientation. The speed of movement of the ramp feed belts 70 is slightly greater than the speed of movement of feed belts in the main section 32. The higher speed of the ramp feed belts enables the signatures 26 to tip forwardly and move upwardly away from the main section 32 in a thick shingled stream. The thick shingled stream has a thickness of more than one inch, usually three to five inches as measured perpendicular to the upper side of the ramp section 38. Since the signatures are fed up the ramp section 38 in a thick shingled stream, the signatures cooperate with each other to maintain registration between the signatures. Therefore, external registering devices are not necessary.

The ramp section 38 slopes forwardly and upwardly from the main section 32 to the hopper section 34 at an acute angle of approximately 35 degrees to a horizontal plane. The major side surfaces 42 and 44 of the signatures on the ramp section 38 are tilted at an angle of approximately 70 degrees to a horizontal plane. Therefore, the upright major side surfaces 42 and 44 of the signatures 26 on the ramp section 38 are skewed at an angle of approximately 35 degrees to the upper side surface of the ramp section. It should be understood that the ramp section 38 and signatures 26 could slope at angles other than the specific angles set forth above.

The angle at which the major side surfaces 42 and 44 of the on-edge signatures 26 are skewed relative to the upper side of the ramp section 38 may vary depending upon the characteristics of the particular signatures being transported, the speed of movement of the ramp section conveyor belts relative to the speed of movement of the main section conveyor belts and the angular orientation of the ramp section 38. It has been determined that the upper side of the ramp section may be skewed at an angle between 20 and 45 degrees relative to a horizontal plane. Of course, the slope of the ramp section 38 should not be so great as to cause the signatures to slide rearwardly down the ramp section. However, the slope of the ramp section 38 should be sufficient to enable a sliding action to occur between the major side surfaces 42 and 44 of the on-edge signatures as they move from the main section 32 up the ramp section 38 to facilitate subsequent separating of the signatures from each other at the hopper section 34.

It is contemplated that the signatures 26 will move up the ramp section 38 with their major side surfaces skewed at an angle in the range of 10 degrees to 40 degrees from a vertical plane. The greater the angle at which the ramp section 38 extends upwardly, the smaller is the angle at which the major sides 42 and 44 of the signatures are skewed relative to the ramp section. Regardless of the angle at which the ramp section 38 extends upwardly, the signatures 26 are maintained in an on-edge orientation and the major side surfaces 42 and 44 of the signatures slope forwardly and upwardly and are spaced from the upper side of the ramp section.

To promote smooth movement of the signatures through the ramp section 38 and into the hopper section 34, the major sides 42 and 44 of the signatures on the ramp section may be skewed at approximately the same angle relative to a horizontal plane as are the signatures in the hopper section 34. This promotes a smooth flow of the thick shingled stream of signatures from the ramp section 38 into the hopper section 34.

A pair of jogger plates 100 (FIG. 3) are disposed on opposite sides of the ramp section 38. The jogger plates 100 are continuously reciprocated toward and away from opposite sides of the ramp section 38 to maintain the opposite sides of the signatures 26 in alignment with the ramp section. In addition, a circular wheel or roller 102 (FIG. 4) engages the upper edges of the signatures 26 at the transition between the main and ramp sections 32 and 38 to promote a smooth feeding of on-edge signatures onto the ramp section 38.

Hopper Section

The hopper section 34 holds signatures to be fed one at a time by the feed apparatus 14. Although the feed chains 78 in the hopper section 34 are driven by the signature feed assembly 14, the hopper section 34 is part of the signature supply assembly 12 and is connected with the main section 32 and ramp section 38 for movement therewith when the signature supply assembly is moved relative to the signature feed assembly.

The hopper section 34 extends forwardly and downwardly from a junction with the ramp section 38. The hopper section 34 supports the signatures 26 on-edge with the major side surfaces 42 and 44 of the signatures extending perpendicular to the feed chains 78 The major side surfaces of the upright signatures in the hopper section 34 may be generally parallel to the major side surfaces of the signatures in the ramp section 38. By having the major side surfaces of the signatures in the hopper section 34 generally parallel to the major side surfaces of the signatures 26 on the ramp section 38, the smooth movement of the thick shingled stream of upright signatures on the ramp section 38 into the hopper section 34 is promoted.

In the embodiment of the invention illustrated in FIGS. 3 and 4, the hopper section 34 extends forwardly and downwardly at an angle of approximately 20 degrees to a horizontal plane. The longitudinal central axis 104 (FIG. 4) of the hopper section 34 intersects the longitudinal central axis 48 of the ramp section 38 at an angle of about 125 degrees. Of course, the particular angle at which the central axis 104 of the hopper section 34 is located will depend upon the specific construction of the signature feed apparatus 14 with which the signature supply apparatus is used.

As the signatures 26 move into the hopper section 34, they engage a pair of side guides 106. The side guides 106 engage opposite edge portions of the on-edge signatures 26 and position them relative to the hopper section 34. During forward movement of the signatures 26 by the hopper feed chains 78, the side guides 106 maintain the upright signatures 26 in sidewise alignment with the hopper section 34.

As signatures are fed one at a time from the hopper section 34 by the signature feed assembly 14, the on-edge signatures in the hopper section may tend to fall backward toward the ramp section 38. In order to prevent this from happening, a retainer wedge 110 (FIG. 4) engages the signatures 26 and holds them in place. Thus, the retainer wedge 110 has a downwardly facing lower side surface 112 which engages the upper edge portions of the signatures as they move into the hopper section 34. The surface 112 of the retainer wedge 110 applies a relatively light force against the upper edge of the signatures 26. This force is just sufficient to hold the on-edge signatures against any tendency to fall backward while enabling them to readily move forwardly. The height of the retainer wedge 110 can be adjusted vertically to accommodate signatures 26 of different heights.

A sensor 116 (FIG. 4) is provided to detect when the number of signatures in the hopper section 34 has been reduced by the signature feed apparatus 14. In response to the sensor 116 detecting that the number of signatures in the hopper section 34 has been reduced, the drive assembly 54 (FIG. 3) is energized to move additional signatures into the hopper section 34. The drive assembly 54 continues to operate until the sensor 116 detects that the hopper section 34 is again filled with signatures. When the sensor assembly 116 detects that the hopper section is filled with signatures, operation of the drive assembly 54 is interrupted.

The sensor assembly 116 effects an intermittent operation of the drive assembly 54. Thus, after several signatures have been fed one at a time from the hopper section 34 by the signature feed assembly 14, the sensor assembly 116 detects that the number of on-edge signatures in the hopper section has been reduced. The drive assembly 54 is then activated to move additional signatures into the hopper section 34. As soon as the hopper section 34 becomes filled with signatures, the sensor assembly 116 interrupts operation of the drive assembly 54.

Although the operation of the drive assembly 54 is intermittent, during normal operation of the signature feed assembly 14, the operation of the drive assembly 54 approaches continuous operation. This is because the signatures are continuously removed from the hopper section 34 by the signature feed apparatus.

The sensor assembly 116 includes a light source which directs a beam of light against the signatures in the hopper section 34. The light reflected from the signatures is detected by the sensor assembly 116. As the signatures 26 are fed one at a time from the hopper section 34 by the signature feed assembly 14, the surface from which the light is reflected back to the sensor assembly 116 moves away from the sensor assembly. This results in a decrease in the intensity of the reflected light.

After the surface from which the light is reflected has moved through a short distance relative to the sensor assembly 116, the sensor assembly detects the resulting decrease in the intensity of the reflected light. When this occurs, the sensor assembly 116 activates the drive assembly 54 to feed additional signatures to the hopper section 34. As additional signatures are supplied to the hopper section 34, the intensity of the light reflected from the signatures increases until a reflected light of a predetermined intensity is detected by the sensor assembly 116. When this occurs, the sensor assembly 116 deactivates the drive assembly 54 to momentarily stop the feeding of signatureS intO the hopper section 34.

When the signature supply assembly 12 is initially set up to supply signatures to the signature feed assembly 14, on edge signatures 26 are loaded on the main section 32. In addition, on edge signatures 26 are manually loaded into the hopper section 34. However, the hopper section 34 is not completely filled with signatures. At this time, the ramp section 38 is empty.

Since the hopper section 34 is not filled with signatures 26, the sensor assembly 116 activates the drive assembly 54. This results in signatures moving from the main section up the ramp section 38 to the hopper section 34. When the ramp section 38 and hopper section 34 have been filled with on edge signatures, the sensor assembly 116 deactivates the drive assembly 54. Of course, during subsequent operation of the signature feed assembly 14, the sensor assembly again activates the drive assembly 54 to keep the hopper section 34 full of signatures

Deflector Assembly

The deflector assembly 82 deflects each of the on-edge signatures 26 in the continuous stream 52 (FIG. 1) of signatures as each signature moves through the deflector assembly. Each of the upright signatures 26 is deflected in such a manner as to cause the signature to bow or arcuately curve forwardly in the direction of movement of the stream 52 of signatures. The deflector assembly 82 accomplishes this by applying a rearwardly and inwardly directed force against opposite sides of each of the on-edge signatures in turn.

As a signature is resiliently bowed by the deflector assembly 82, the major side surfaces of the signature move forwardly and at least partially out of engagement with the major side surfaces of adjacent signatures. This breaks any forces tending to cause the major side surfaces of a signature to adhere to the major sides of the adjacent signatures. Although the deflector assembly 82 will be very helpful in conjunction with signatures which have a relatively strong tendency to adhere to each other, use of the deflector assembly may not be necessary with other signatures.

When the forces causing the signatures 26 to adhere to each other are relatively weak, movement of the on-edge signatures 26 up the ramp section 38 may result in enough relative movement between the major sides 42 and 44 of the upright signatures to eliminate or at least greatly reduce any tendency of the signatures to adhere to each other. When this is the situation, the deflector assembly 82 may be eliminated. However, when the signatures 26 have a relatively strong tendency to adhere to each other, the deflector assembly 82 will be necessary in order to prevent the feeding of more than one signature at a time from the hopper section 34 and a resulting jamming of the signature feed assembly 14.

The deflector assembly 82 (FIGS. 5 and 6) includes a base frame 122 which is fixedly connected to the main section 32 of the signature supply apparatus 12. The base frame 122 includes a pair of vertically extending leg sections 124 and 126 which are fixedly connected to opposite sides of the main section 32 of the signature supply apparatus 12. A bridge or connector section 128 is fixedly connected to the upper ends of the leg sections 124 and 126 (FIG. 6) and extends across the continuous stream 52 of signatures 26.

Figure 6:
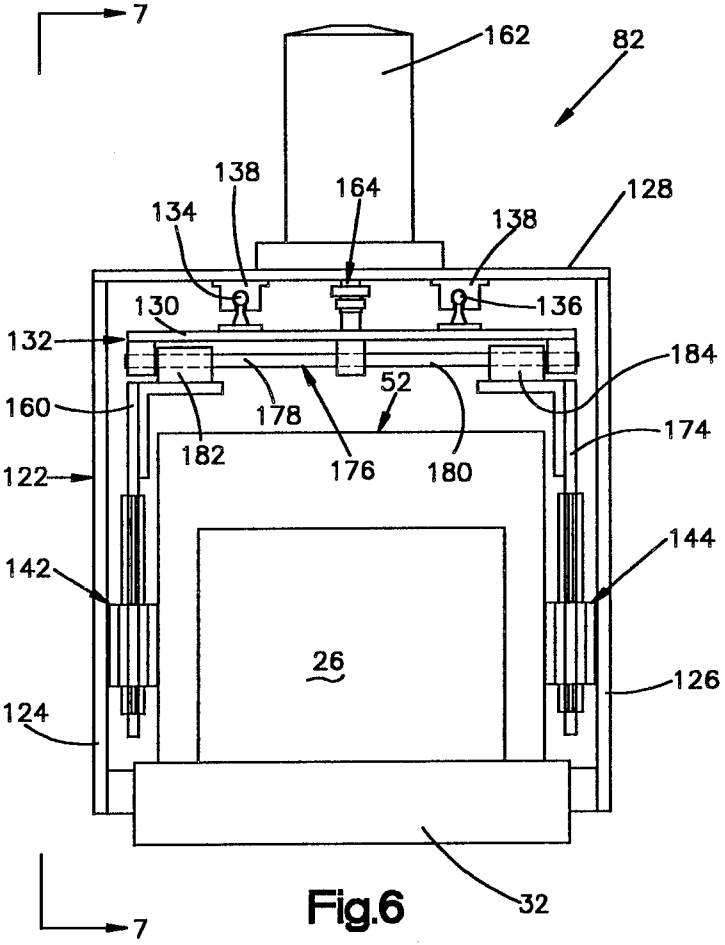
FIG. 6 is an elevational view of the deflector assembly of FIG. 5, illustrating the relationship between the deflector assembly and a stream of on-edge signatures supported by the main section of the signature supply assembly.

A movable carriage 132 is mounted between the legs 124 and 126 and is disposed beneath the horizontal bridge section 128 (FIG. 6). The carriage 132 includes an upper section 130 which extends across the continuous stream 52 of signatures 26. The horizontal upper section 130 is provided with a pair of horizontal rails 134 and 136 which slidably engage bearings 138 (FIG. 6) disposed on the underside of the bridge section 128. The bearings 138 and rails 134 and 136 support the carriage 132 for reciprocating movement along a relatively short path which extends parallel to the longitudinal central axis of the portion of the stream 52 of signatures 26 disposed on the main section 32 of the signature feed apparatus 12.

Figure 7:
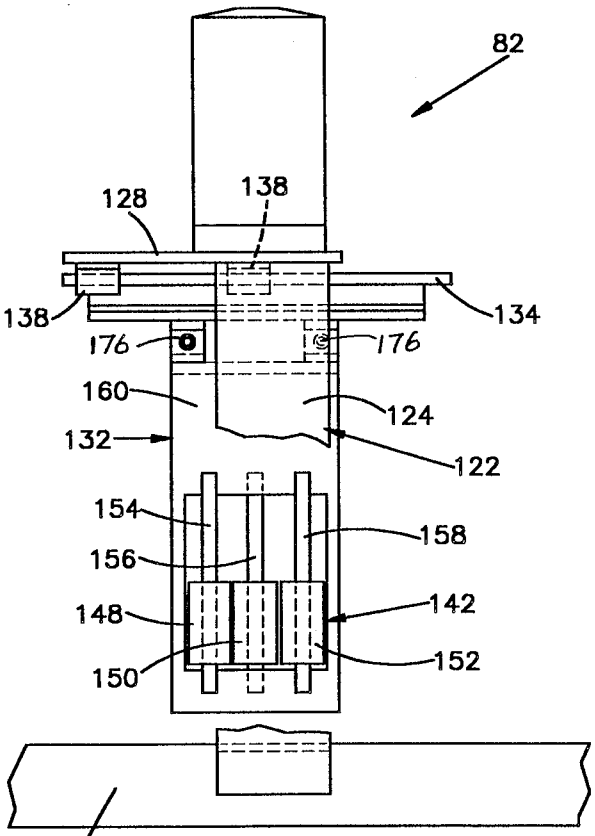
FIG. 7 is a partially broken away side elevational view, taken generally along the line 7—7 of FIG. 6, further illustrating the construction of the deflector assembly.

A pair of identical arrays 142 and 144 of cylindrical rollers are rotatably mounted on the carriage 132. Rollers in the two arrays 142 and 144 have cylindrical outer side surfaces which engage opposite sides of the stream 52 of on-edge signatures. The array 142 (FIG. 7) of rollers includes three cylindrical rollers 148, 150 and 152 which are rotatably mounted on vertical shafts 154, 156 and 158 on the carriage 132. The shafts 154 and 158 are mounted on the outer side of a vertical leg 160 which extends downwardly from the upper section 130 of the carriage 132. The roller shaft 156 is mounted on the inner side of the leg 160. Although only the rollers 148, 150 and 152 for the array 142 of rollers are shown in FIG. 7, it should be understood that the array 144 of rollers has the same construction as the array 142 of rollers. The array 144 of rollers is mounted on a leg 163 which extends downwardly from the upper section 130 of the carriage 132.

A one-way clutch assembly is associated with each of the rollers in each array 142 and 144 of rollers. The one-way clutch assemblies allow the rollers to freely rotate during foward movement of the carriage 132 along the continuous stream 52 of on-edge signatures. However, during backward or reverse movement of the carriage 132 along the stream of signatures, the one-way clutches hold the rollers against rotation. This results in the outer edge portions of the signatures being moved rearwardly by the rollers to bow the signatures forwardly and separate the major side surfaces of adjacent signatures.

The carriage 132 is reciprocated back and forth relative to the stream 52 of signatures 26 by operation of a drive motor 162 mounted on the bridge or connector section 128 of the frame 122. The motor 162 is connected with the carriage 132 by a crank assembly 164. The crank assembly 164 includes a relatively short arm which is fixedly secured to an output shaft of the motor 162 and a relatively long arm which is pivotally connected to the carriage 132. Upon rotation of the output shaft of the motor 162, the short arm of the crank assembly 164 is rotated to reciprocate the carriage 132 back and forth along the stream 52 of signatures.

The legs 160 and 174 of the carriage 132 are supported from the upper section 130 by a pair of rods 176. Each of the horizontal rods 176 has an end portion 178 with righthand threads and an end portions 180 with lefthand threads. The righthand and lefthand threaded end portions 178 and 180 of the rod 176 engage similarly threaded nuts 182 and 184. By rotating the shaft 176, the nuts 182 and 184 move the arms 172 and 174 either toward each other or away from each other to enable the arrays 142 and 144 of rollers to engage signatures of various widths.

Summary

An improved signature supply assembly 12 conducts signatures 26 in an on-edge orientation to a known signature feed assembly 14 which feeds the signatures one at a time. The signature supply assembly 12 has a relatively long main section 32 and supports a substantial number of signatures 26 in an on-edge orientation with major side surfaces 42 and 44 of the signatures 26 upright. A hopper section 34 is disposed at a higher level than the main section 32 to support signatures 26 on edge with major side surfaces of the signatures upright. The signature 24 which is to be engaged next by the signature feed assembly 14 is disposed at the forward end of the hopper section 34 (FIG. 2). An inclined ramp section 38 extends forwardly and upwardly from the main section 32 to the hopper section 34 to support on-edge signatures with major side surfaces of the signatures inclined forwardly and upwardly.

The main, ramp and hopper sections 32, 38 and 34 of the signature supply assembly 12 support a continuous stream 52 of on-edge signatures 26. A drive assembly 54 presses the major side surfaces 42 and 44 of the signatures 26 on the main and ramp sections 32 and 38 against each other to transmit force between the signatures urging the signatures forwardly and upwardly toward the hopper section 34.

The signatures 26 may tend to adhere to each other causing a misfeed by the signature feed assembly 14. To prevent this from occurring, a deflector assembly 82 may be provided to bow the signatures. The deflector assembly 82 bows the signatures 26 to facilitate subsequent feeding of the signatures one at a time from the end of the stream 52 of signatures. The deflector assembly 82 includes arrays 142 and 144 of rollers which engage opposite sides of the stream 52 of signatures and which rotate in only one direction during back and forth movement of the rollers along the stream of signatures.

Having described a preferred embodiment of the invention, I claim:

1. A signature supply apparatus for supplying signatures in an on-edge orientation to a signature feed apparatus which feeds signatures one at a time, said signature supply apparatus comprising a generally horizontal main section having means for supporting signatures on edge with major side surfaces of the signatures upright, a hopper section disposed at a higher level than said main section for supporting signatures on edge with major side surfaces of the signatures upright and with the signature to be engaged next by the signature feed apparatus disposed at a forward end of said hopper section furthest from said main section, an inclined ramp section extending forwardly and upwardly from said main section to said hopper section for supporting signatures on edge in a thick shingled stream with major side surfaces of the signatures inclined forwardly and upwardly relative to a longitudinal central axis of said ramp section, said main, ramp and hopper sections of said apparatus including surface means for supporting a continuous stream of on-edge signatures extending from said main section to the signature disposed at the forward end of said hopper section in a position to be engaged by the signature feed apparatus, and drive means for pressing the major side surfaces of the signatures on said main and ramp sections against each other to transmit force between the signatures on said ramp section urging the signatures on said ramp section forwardly and upwardly toward said hopper section.

2. A signature supply apparatus as set forth in claim 1 further including deflector means for deflecting the on-edge signatures on said main section to bow the signatures to facilitate subsequent feeding of the signatures one at a time by the signature feed apparatus.

3. A signature supply apparatus as set forth in claim 2 wherein said deflector means includes a first plurality of rollers disposed on a first side of said main section for engaging first edge portions of the signatures and a second plurality of rollers disposed on a second side of said main section for engaging second edge portions of the signatures, reciprocator means for moving said first and second plurality of rollers forwardly and rearwardly along the stream of on-edge signatures disposed on said main section, and means for preventing rotation of said rollers during movement of said rollers in one direction along the stream of on-edge signatures and for enabling said rollers to rotate during movement of said rollers along the stream of on-edge signatures in a direction opposite to the one direction.

4. A signature supply apparatus as set forth in claim 1 further including wheel means for supporting said main, ramp and hopper sections for movement relative to the signature feed apparatus.

5. A signature supply apparatus as set forth in claim 1 wherein said drive means includes means for applying force against a major side surface of a signature on said main section and belt means for engaging lower edge portions of on-edge signatures disposed on said main and ramp sections.

6. A signature supply apparatus as set forth in claim 1 wherein major side surfaces of the signatures are skewed at an angle of 10 to 35 degrees from a vertical plane during movement of the signatures along said ramp section.

7. A signature supply apparatus as set forth in claim 1 wherein said ramp section has an upwardly sloping side which supports lower edges of the signatures during movement of the signatures along said ramp section with major side surfaces of the signatures skewed at an angle of 20 to 50 degrees relative to said upwardly sloping side of said ramp section.

8. A signature supply apparatus as set forth in claim 1 wherein said ramp section has a side which slopes upwardly at an angle of 20 to 45 degrees relative to a horizontal plane and which supports lower edges of the signatures during movement of the signatures along said ramp section with major side surfaces of the signatures skewed at an angle of 20 to 50 degrees relative to said side of said ramp section.

9. A signature supply apparatus as set forth in claim 1 further including retainer means for engaging upper edge portions of signatures in said hopper section and preventing movement of the signatures in said hopper section back toward said ramp section as signatures are fed from said hopper section by the signature feed apparatus.

10. A signature supply apparatus as set forth in claim 1 further including jogger means for applying forces against opposite sides of the thick shingled stream of on-edge signatures as the signatures move along said ramp section, said jogger means including a pair of jogger plates disposed on opposite sides of said ramp section and having side surfaces for engaging side edge portions of the signatures at locations below upper edge portions of the signatures.

11. A signature supply apparatus as set forth in claim 1 wherein said hopper section has a side which slopes forwardly and downwardly toward the signature feed apparatus, said side of said hopper section supporting the on-edge signatures in said hopper section with major side surfaces of the signatures extending generally perpendicular to said side of said hopper section, said ramp section having a side which slopes forwardly and upwardly toward said hopper section, said side of said ramp section supporting the on-edge signatures in said ramp section with major side surfaces of the signatures extending generally parallel to the major sides of the on-edge signatures in said hopper section.

12. A signature supply apparatus for supplying signatures in an on-edge orientation to a signature feed apparatus which feeds signatures one at a time, said signature supply apparatus comprising means for supporting a continuous stream of on-edge signatures extending to a signature disposed in a position to be engaged by the signature feed apparatus, and deflector means for deflecting the on-edge signatures to bow the signatures in a direction parallel to the longitudinal axis of the stream of on-edge signatures to facilitate subsequent feeding of the signatures one at a time from the end of the stream of signatures by the signature feed means, said deflector means including a first plurality of rollers rotatable about axes which extend transversely to the longitudinal axis of the stream of on-edge signatures and which are spaced along the longitudinal axis of the stream of on-edge signatures, said first plurality of rollers having outer side surfaces which engage upright edge portions of the on-edge signatures along a first side of the stream of signatures, said deflector means including a second plurality of rollers rotatable about axes extending transversely to the longitudinal axis of the stream of on-edge signatures and which are spaced apart along the longitudinal axis of the stream of on-edge signatures, said second plurality of rollers having outer side surfaces which engage upright edge portions of the on-edge signatures along a second side of the stream of signatures opposite from the first side of the stream of signatures, carriage means extending across the stream of on-edge signatures and connected with said first and second pluralities of rollers to support said first and second pluralities of rollers for movement along the stream of signatures, drive means for reciprocating said carriage forwardly and rearwardly along the stream of on-edge signatures to repeatedly move said first and second pluralities of rollers through forward and rearward operating strokes along the stream of on-edge signatures, and means connected with said first and second pluralities of rollers for preventing rotation of said first and second pluralities of rollers during operating strokes of said first and second pluralities of rollers in one direction along the stream of on-edge signatures and for enabling said first and second pluralities of rollers to rotate during operating strokes of said first and second pluralities of rollers in a direction opposite to the one direction.

13. A signature supply apparatus as set forth in claim 12 wherein said means for supporting a continuous stream of on-edge signatures includes a generally horizontal main section having means for supporting a portion of the stream of on-edge signatures with major side surfaces of the signatures upright, a hopper section disposed at a higher level than said main section for supporting signatures on edge with major side surfaces of the signatures upright and with the signature to be engaged next by the signature feed apparatus disposed at a forward end of said hopper section furthest from said main section, an inclined ramp section extending forwardly and upwardly from said main section to said hopper section for supporting signatures on edge with major side surfaces of the signatures inclined forwardly and upwardly relative to a longitudinal central axis of said ramp section, and drive means for pressing the major side surfaces of the signatures on said main and ramp sections against each other to transmit force between the signatures on said ramp section urging the signatures on said ramp section forwardly and upwardly toward said hopper section.

14. A signature supply apparatus as set forth in claim 13 wherein said outer side surfaces of said first plurality of rollers and said outer side surfaces of said second plurality of rollers engage edge portions of the upright signatures as the signatures move along said main section of said means for supporting a continuous stream of signatures.

15. A signature supply apparatus for supplying signatures in an on-edge orientation to a signature feed apparatus which feeds signatures one at a time, said signature supply apparatus comprising a main section having means for supporting signatures on edge with major side surfaces of the signatures upright, a hopper section disposed at a higher level than said main section for supporting signatures on edge with major side surfaces of the signatures upright and with the signature to be engaged next by the signature feed apparatus disposed at a forward end of said hopper section furthest from said main section, an inclined ramp section extending forwardly and upwardly from said main section to said hopper section for supporting signatures on edge with major side surfaces of the signatures inclined forwardly and upwardly relative to a longitudinal central axis of said ramp section, said main, ramp and hopper sections of said apparatus including surface means for supporting a continuous stream of on-edge signatures extending from said main section to the signature disposed at the forward end of said hopper section in a position to be engaged by the signature feed apparatus, drive means for pressing the major side surfaces of the signatures on said main and ramp sections against each other to transmit force between the signatures on said ramp section urging the signatures on said ramp section forwardly and upwardly toward said hopper section, said drive means including means for applying force against a major side surface of a signature on said main section and belt means for engaging lower edge portions of on-edge signatures disposed on said main and ramp sections, and wheel means for supporting said main, ramp and hopper sections for movement relative to the signature feed apparatus.

16. A signature supply apparatus as set forth in claim 15 further including deflector means for deflecting the on-edge signatures on said main section to bow the signatures to facilitate subsequent feeding of the signatures one at a time by the signature feed apparatus.

17. A signature supply apparatus as set forth in claim 15 wherein major side surfaces of the signatures are skewed at an angle of 10 to 35 degrees from a vertical plane during movement of the signatures along said ramp section.

* * * * *